US006764327B2

(12) United States Patent
Yu

(10) Patent No.: US 6,764,327 B2
(45) Date of Patent: Jul. 20, 2004

(54) ELECTRICAL CARD CONNECTOR WITH END POSITION SWITCH

(75) Inventor: Zhi Nong Yu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/293,125

(22) Filed: Nov. 12, 2002

(65) Prior Publication Data

US 2003/0236013 A1 Dec. 25, 2003

(30) Foreign Application Priority Data

Jun. 20, 2002 (TW) ..... 91209265 U

(51) Int. Cl.[7] ..... H01R 29/00; H01R 24/00
(52) U.S. Cl. ..... 439/188; 439/630
(58) Field of Search ..... 439/188, 630, 439/635, 637, 260; 200/51.06, 51.1, 489

(56) References Cited

U.S. PATENT DOCUMENTS 4,900,273 A 2/1990 Pernet
5,013,255 A 5/1991 Juret et al.
5,334,034 A 8/1994 Reichardt et al.
5,370,544 A 12/1994 Reichardt et al.
5,667,397 A 9/1997 Broschard, III et al.
6,004,155 A 12/1999 Wu
6,132,229 A 10/2000 Wu
6,382,993 B1 * 5/2002 Chen ..... 439/157
6,425,775 B1 7/2002 Chang
6,431,893 B1 8/2002 Chang

* cited by examiner

*Primary Examiner*—Chandrika Prasad
(74) *Attorney, Agent, or Firm*—Wei Te Chung

(57) ABSTRACT

An electrical card connector (700) has a housing (2) and an end position switch (3). The end position switch includes a first spring contact (31) and a second spring contact (32). The first and second spring contacts respectively have body portions (313, 323), and contact arms (314, 324) extending from the body portions. The first spring contact has a resilient contact portion (312) slantways extending from the body portion. The second spring contact has a guide portion (318) extending downwardly from the contact arm. When an electrical card is inserted into the connector, the contact arm of the first spring contact moves onto and contacts with the contact arm of the second spring contact along the guide portion of the second spring contact.

21 Claims, 5 Drawing Sheets

ELECTRICAL CARD CONNECTOR WITH END POSITION SWITCH

CROSS-REFERENCE TO RELATED APPLICATION

This application is related to, U.S. patent applications entitled "CARD CONNECTOR HAVING LOW PROFILE", with a Ser. No. 10/299,261, and "ELECTRICAL CARD CONNECTOR WITH SPRING SWITCH", with a Ser. No. 10/293,412, and assigned to the common assignee.

BACKGROUND OF THE INVENTION

1. Field of the Invention

The present invention relates to an electrical connector, and more particular to a card edge connector assembly having an end position switch to detect full insertion of an electrical card received therein.

2. Description of the Prior Art

Generally, an electrical card or chip card as presently used contains recording media in the card itself. This recording media or intelligence is typically in the form of a memory circuit that contains read only memory (ROM) or read/write memory (random access memory, RAM). The information stored in the read only memory or read/write memory then is used by card reader or card interface device to detect certain information. An electrical connector for receiving such an electrical card or chip card often has an end position switch indicating whether the card is fully inserted.

U.S. Pat. No. 4,900,273, issued to Pernet on Feb. 13, 1990, discloses a conventional card connector which has an end-of-stroke contact. The end-of-stroke contact of Pernet has a moving blade and a fixed contact. Before an electrical card is inserted into the connector, the end-of-stroke contact is in a closed position, and a bearing surface of the fixed contact resiliently contacts the shaped contact surface of the moving blade. When the electrical card is fully inserted into the connector, an edge of the card pushes a retaining finger of the moving blade, so that the shaped contact surface is pushed away from bearing surface of the fixed contact, and the end-of-strode contact is from the closed position to an open position to indicate the card is fully inserted.

However, too much deformation exerted on the moving blade of the end-of-stroke contact by insertions of the card will result in overwork of the moving blade, and the closed position of the end-of-stroke contact prior to the card being inserted into the connector is demolished. As a result, the electrical connector can not exactly indicate whether the card has been fully inserted.

Hence, an improved electrical connector with an improved end position switch to indicate the full insertion of an electrical card is needed to solve the above problems.

BRIEF SUMMARY OF THE INVENTION

A main object of the present invention is to provide an electrical card connector having an improved end position switch to extend the life thereof.

To fulfill the above-mentioned object, an electrical card connector of present invention has a housing and an end position switch located in a rear part of the housing, The end position switch is triggered by an electrical card inserted into the connector. The end position switch is normally in an open position, and includes a first spring contact and a second spring contact. The first spring contact is secured in front of the second spring contact. The first and second spring contacts respectively have body portions, fixing portions extending from ends of the body portions, soldering portions extending from the fixing portions for soldering the first and second spring contacts to a printed circuit board (PCB), and contact arms extending from free ends of the body portions. The first spring contact has a resilient contact portion slantways extending from the body portion. The second spring contact has a guide portion extending downwardly from the contact arm thereof. When the electrical card is inserted into the connector, the resilient contact portion is pushed by the card, and the contact arm of the first spring contact moves onto and contacts the contact arm of the second spring contact. Thus, circuit traces on the PCB are electrically connected through the contact arms of the first and second spring contacts to indicate whether the card is inserted fully.

Other objects, advantages and novel features of the invention will become more apparent from the following detailed description when taken in conjunction with the accompanying drawings.

DETAILED DESCRIPTION OF THE INVENTION

Figure 1:
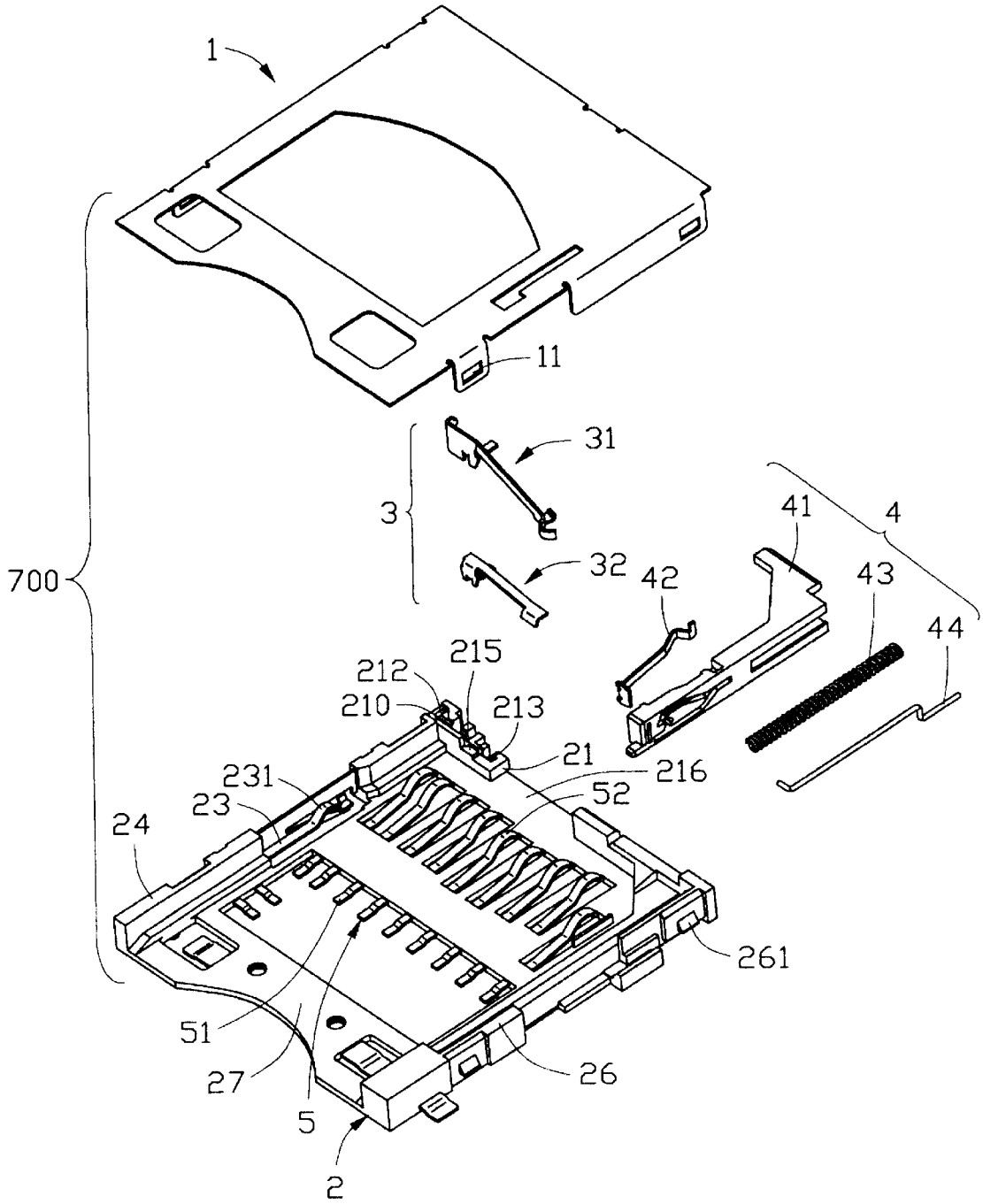
FIG. 1 is an exploded view of an electrical connector in accordance with the present invention.
Figure 2:
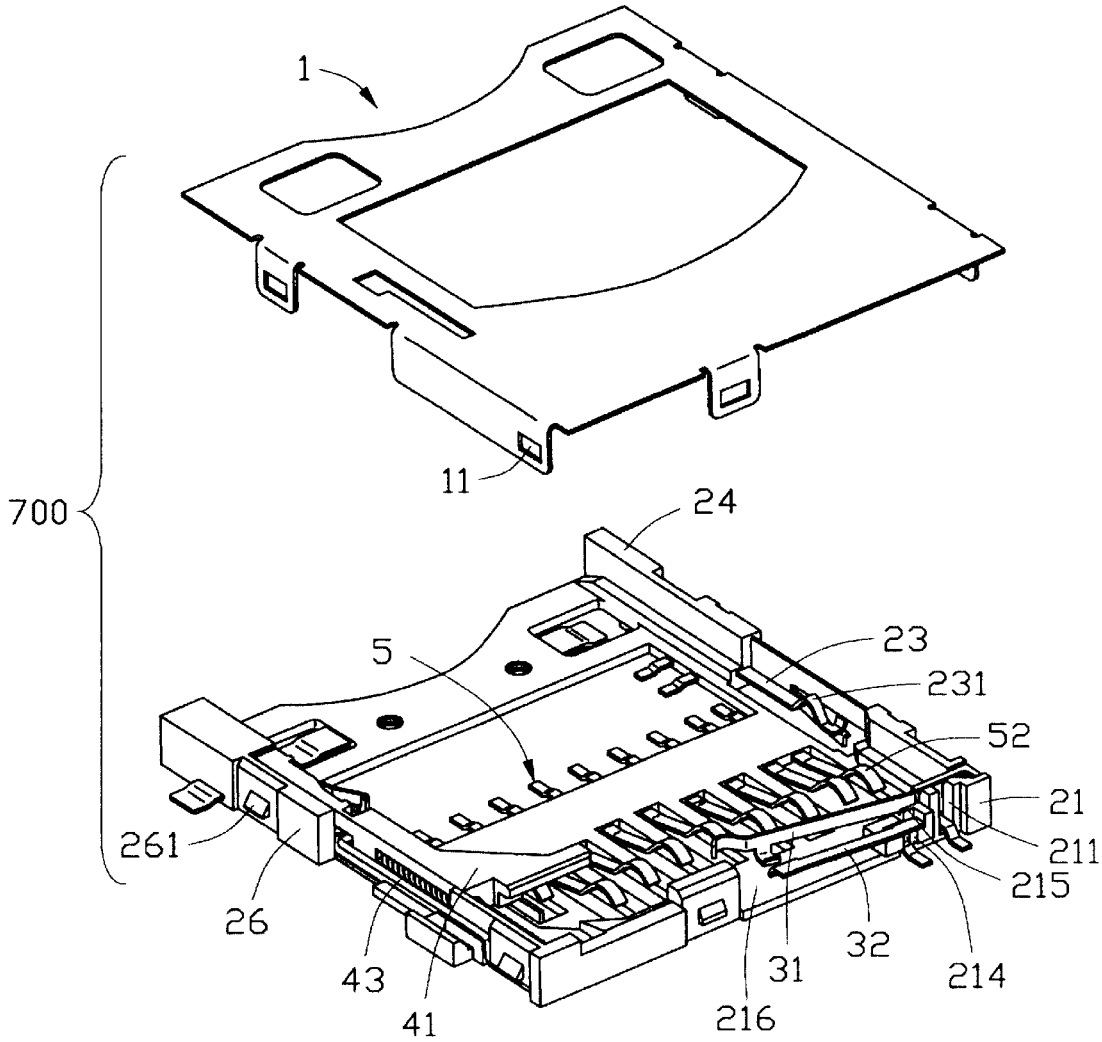
FIG. 2 is an assembled view of FIG. 1, with the shield not assembled to the housing.
Figure 3:
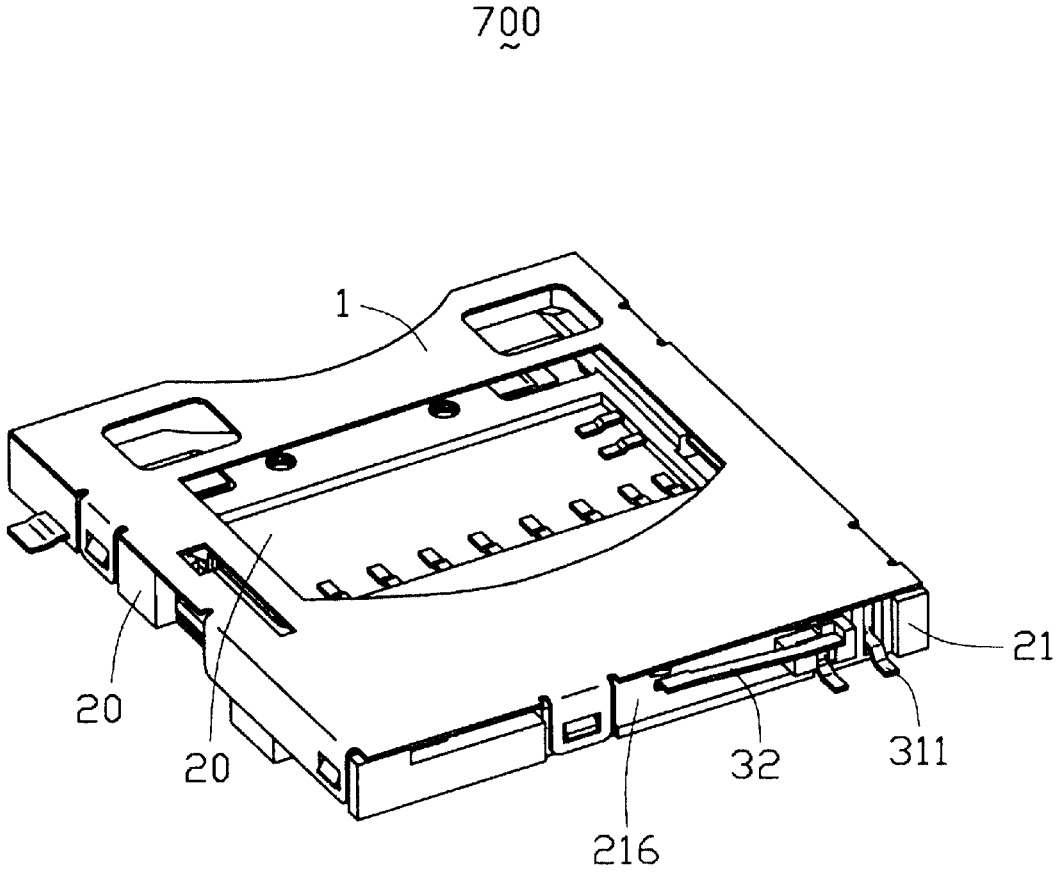
FIG. 3 is an assembled view of FIG. 1.

Referring to FIGS. 1, 2 and 3, an electrical connector 700 of present invention has a shield 1, a housing 2, an end position switch 3, and an ejector 4. The shield 1 has a plurality of openings 11. The housing 2 has a pair of peripheral rims 24, 26, and a rear rim 21 respectively extending around the two sides and partially along a rear portion of a upper surface 27 of the housing 2. The peripheral rims 24, 26 and the rear rim 21 have a plurality of locking tabs 261 for respectively engaging with the openings 11 of the shield 1. The shield 1 and the housing 2 together define a receiving lot 20 for receiving an electrical card (not shown). The ejector 4 of the electrical connector 700 has a slider 41, a sliding contact 42, a spring 43 and a rotating shaft 44.

The electrical connector 700 has a plurality of terminals 5 mounted in the housing 2. The terminals 5 are resilient and each has a soldering section 51 for soldering to a printed circuit board (PCB, not shown), and a contacting section 52 extending above the upper surface 27 of the housing 2 for engaging a corresponding contact pad on the electrical card, so that data can be read from or written into the electrical card by smart interface circuitry in a known way.

The electrical connector 700 has a relief contact 23 mounted on the peripheral rim 24 of the housing 1. The relief contact 23 has a contacting part 231 normally extending above the upper surface 27 of the housing 2 in the receiving slot 20. The relief contact 23 is for detecting if a protect switch of the inserted card is in a write-protect position. Detailed structure of the relief contact 23 is disclosed in pending U.S. patent application Ser. No. 09/876,770, so further description is omitted herein.

The spring switch 3 has a first spring contact 31 and a second spring, contact 32. The rear rim 21 of the housing 1 has a pair of cavities 210, 213, a pair of grooves 211, 214 communicating with corresponding cavities 210, 213, and a notch 212 in communication with the cavity 210. The cavity 213 and the groove 214 are shaped for receiving the second spring contact 32. The first spring contact 31 and the second spring contact 32 are positioned in the rear rim 21 and separated by an insulative portion 215 of the rear rim 21. The first spring contact 31 is secured in front of the second contact 32. The rear rim 21 also defines a second opening 216 in substantially middle portion thereof.

Figure 4:
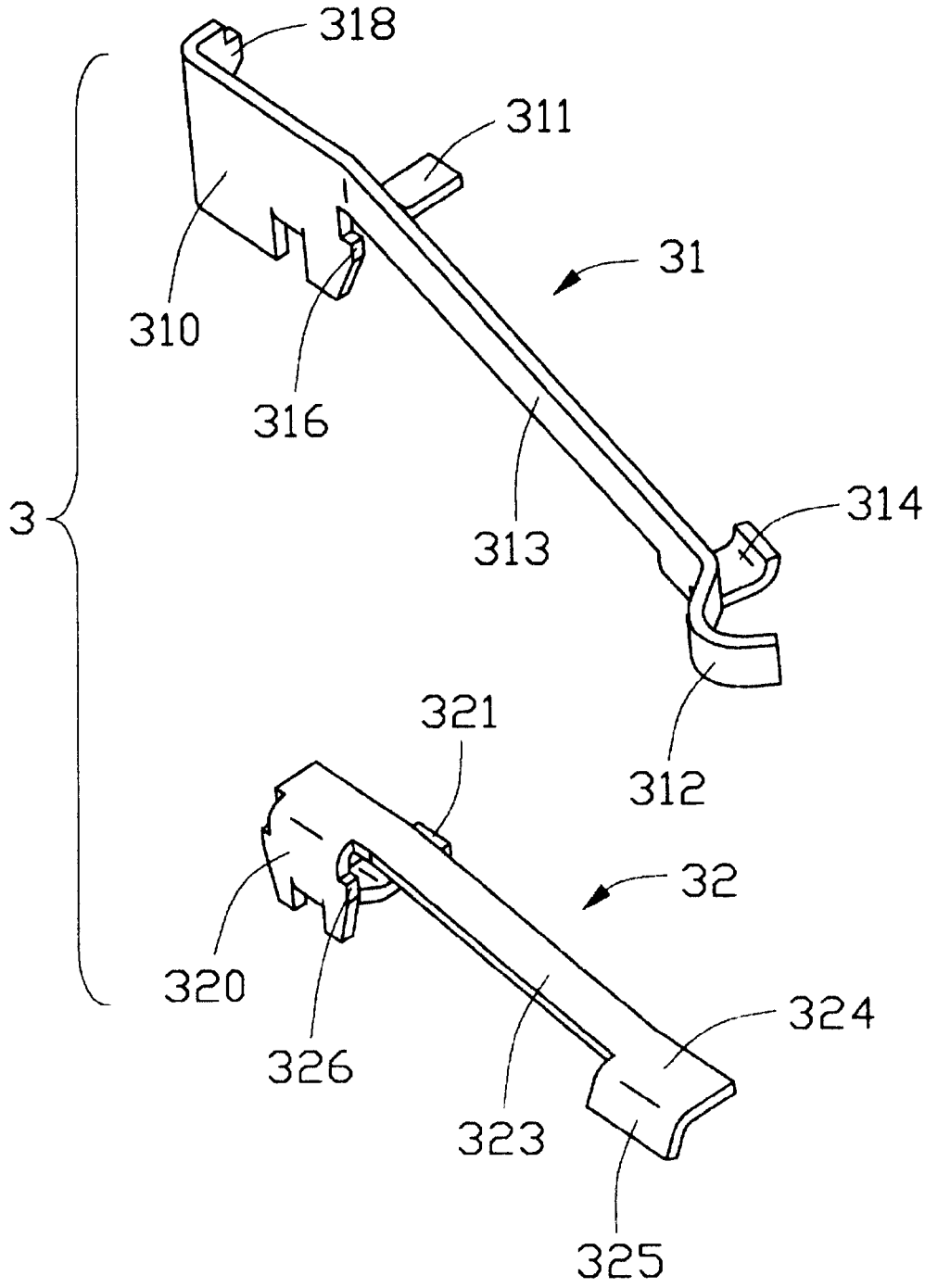
FIG. 4 is a perspective view of the end position switch in accordance with the present invention.
Figure 5:
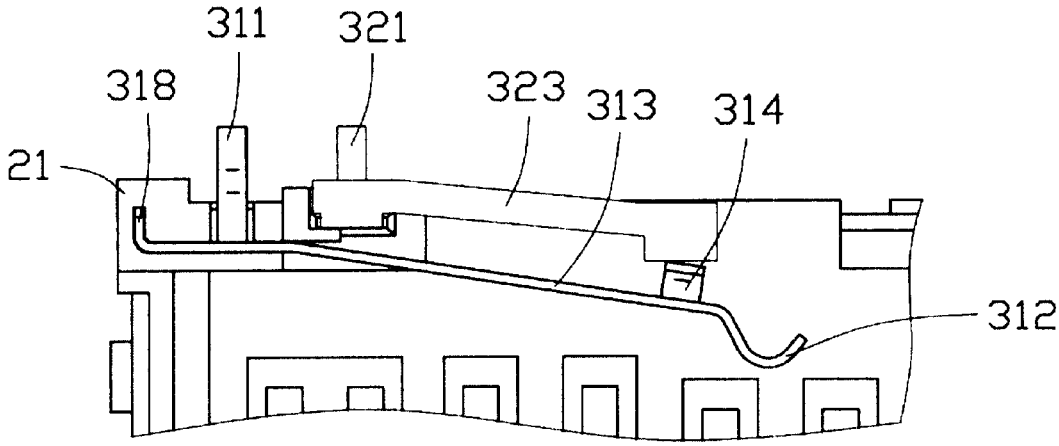
FIG. 5 is a top view of the end position switch assembled in the electrical connector before a card is inserted into the electrical connector.
Figure 6:
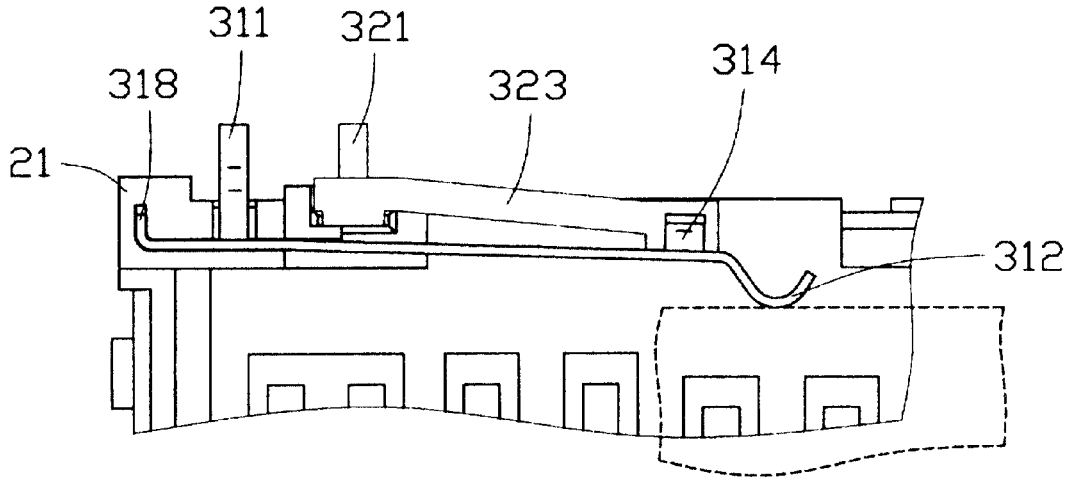
FIG. 6 is a top view of the end position switch assembled in the electrical connector after the card is inserted into the electrical connector.

Referring to FIGS. 4–6, the first spring contact 31 comprises a body portion 313, a resilient contact portion 312 slantways extending from a free end of the body portion 313, and a contact arm 314 extending adjacent to the resilient contact portion 312 for contacting the second spring contact 32. The contact arm 314 extends horizontally and rearwardly from the resilient contact portion 312 and bends slightly and upwardly at a free end thereof. The body portion 313 of the first spring contact 31 has a fixing portion 310 extending from an opposite end thereof, and a soldering portion 311 bending rearwardly from a bottom edge of the fixing portion 310 for soldering the first spring contact 31 to the PCB. The fixing portion 310 of the first spring contact 31 has an engaging portion 318 extending therefrom and perpendicular thereto. The first spring contact 31 has a barb 316 protruding downwardly from the fixing portion 310. The second spring contact 32 has a body portion 323, a contact arm 324 extending horizontally from a free end of the body portion 323, and a guide portion 325 forwardly and downwardly bending from the contact arm 324. The second spring contact 32 has a fixing portion 320 extending substantially perpendicular to the body portion 323, a pair of barbs 326 protruding downwardly from the fixing portion 320, and a soldering portion 321 bending rearwardly from a bottom edge of the fixing portion 320. The soldering portion 321 of the second spring contact 32 secures the second spring contact 32 onto the PCB.

In assembly, the ejector 4 is assembled to the peripheral rim 26 of the housing 2. The fixing portions 310, 320 of the first and second spring contacts 31, 32 are respectively received in the cavities 210, 213. The barbs 316, 326 of the spring contacts 31, 32 in the cavities 210, 213 abut against the rear rim 21 of the housing 2. The soldering portions 311, 321 of the first and second spring contacts 31, 32 respectively extend out of the rear rim 21 of the housing 2 through the grooves 211, 214. The engaging portion 318 of the first spring contact 31 engages with the notch 212 of the rear rim 21 of the housing 2. The second spring contact 32 extends into the second opening 216 of the rear rim 21 of the housing 2, and the first spring contact 31 extends into the receiving slot 20 of the housing 2 and extending away from the second spring contact 32. Thus the first spring contact 31 is secured in front of the second spring contact 32, and the first and second spring contacts 31, 32 are separated by the insulative portion 215 of the housing 2.

In use, the first spring contact 31 is not contacting with the second spring contact 32 before the electrical card is inserted into the electrical connector 700. When the electrical card is inserted into the electrical connector 700, the electrical card pushes the resilient contact portion 312 of the first spring contact 31, so that the body portion 313 of the first spring contact 31 is deflected rearwardly and the contact arm 314 then moves along the guide portion 325 and onto the contact arm 324 of the second spring contact 32. Thus, the first spring contact 31 and the second spring contact 32 contact with each other, and the state of the end position switch 3 is ON to indicate that the electrical card is inserted fully into the electrical connector 700. The ejector 4 works in a known way to eject the electrical card when the card needs to be ejected out of the electrical connector 700.

An advantage of the present invention over the prior art is that the spring contacts 31, 32 of the end position switch 3 are received in the rear rim 21 of the housing 2 and separated by the insulative portion 215. The second spring contact 32 has the guide portion 325, which leads the contact arm 314 of the first spring contact 31 to move onto the contact arm 324 and contact with the contact arm 324 of the second spring contact 32. Thus the end position switch 3 has more flexibility, and may not be destroyed after a period of use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What we claim is:

1. A connector assembly, comprising:

a housing having a rear wall and defining a receiving space for receiving an inserted card;

a first contact mounted in the rear wall, the first contact having a resilient contact portion, the resilient contact portion extending into the receiving space; and a second contact mounted in the rear wall;

wherein the first contact extends away from the second contact and is located at a first position in which the first and second contacts are electrically separated from each other, and a second position in which the first and second contacts are electrically contacted upon in a first direction perpendicular to a second direction in which the inserted card is inserted, when the inserted card acts upon the resilient contact portion of the first contact.

2. The connector assembly as claimed in claim 1, wherein the rear wall of the housing has an opening, the second contact are received in the opening.

3. The connector assembly as claimed in claim 1, wherein the rear wall of the housing defines a first cavity and a notch communicating with the first cavity, the first contact has a first fixing portion and an engaging portion respectively received in the first cavity and the notch.

4. The connector assembly as claimed in claim 3, wherein the first fixing portion and the engaging portion of the first contact are in an L-shaped configuration.

5. The connector assembly as claimed in claim 3, wherein the first fixing portion of the first contact forms a plurality of barbs engaging with the rear wall of the housing.

6. The connector assembly as claimed in claim 1, wherein the rear wall of the housing defines a second cavity, the second contact has a second fixing portion received in the second cavity of the housing.

7. The connector assembly as claimed in claim 6, wherein the second fixing portion of the second contact forms a plurality of barbs engaging with the rear wall of the housing.

8. The connector assembly as claimed in claim 1, wherein the first and second contacts respectively have a first and second body portions, and a first and second contact arms respectively extending from the first and second body portions.

9. The connector assembly as claimed in claim 8, wherein the first contact arm of the first contact extends horizontally and rearwardly from the first body portion.

10. The connector assembly as claimed in claim 8, wherein the resilient contact portion of the first contact extends slantways from the first body portion.

11. The connector assembly as claimed in claim 8, wherein the second contact has a guide portion extending forwardly and downwardly from the second contact arm thereof.

12. The connector assembly as claimed in claim 1, wherein the rear wall of the housing defines a pair of grooves, and the first and second contacts respectively have a first and second soldering portions received in corresponding grooves.

13. The connector assembly as claimed in claim 1, wherein the rear wall of the housing has an insulative portion for separating the first and second contacts.

14. A connector assembly, comprising:

a housing having a rear rim at rear end thereof;

a plurality of terminals disposed in the housing;

a first contact having a first body portion, a first resilient contact portion extending from the first body portion, and a first contact arm extending from the first body portion;

a second contact having a second body portion, a second resilient contact portion extending from the body portion, and a guide portion bending from the second resilient contact portion; wherein the first resilient contact portion can be horizontally urged by an inserted card so that the first contact arm of the first contact moves onto a top surface of the second resilient contact portion and vertically contacts with the second resilient contact portion of the second contact along the guide portion of the second contact.

15. The connector assembly as claimed in claim 14, wherein the first and second contacts have fixing portions extending from the body portions thereof, the rear rim of the housing defines a pair of cavities respectively receiving the fixing portions of the first and second spring contacts.

16. The connector assembly as claimed in claim 15, wherein the first spring contact has an engaging portion bending substantially perpendicular to the first fixing portion thereof.

17. An electrical assembly comprising:

a housing;

a plurality of terminals disposed in the housing;

first and second switch contacts located around a rear portion of said housing;

an electronic card moveable relative to the housing along back-and-forth directions;

said first switch contact defining a first deflectable pivotal body portion moveable relative to the housing in generally said back-to-forth directions, a first contact arm and a contact portion located around an end portion of said first deflectable pivotal body portion; and said second switch contact defining a second deflectable pivotal body portion moveable relative to the housing in generally up-and-down directions perpendicular to said back-and-forth directions, a second contact arm located around an end portion of said second deflectable pivotal body portion; wherein upon engagement between a front edge of the electronic card and the contact portion of the first switch contact, the first body portion of the first switch contact is deflected so as to deflect the second body portion of the second switch contact due to engagement between the first contact arm and the second contact arm.

18. The assembly as claimed in claim 17, wherein the engagement between said electronic card and said contact portion occurs constantly at a same position of the front edge of said electronic card.

19. An end position switch for being used in an electrical connector, comprising:

a first spring contact, having a first body portion, a first fixing portion extending from one end of the first body portion, an engaging portion bending from the first fixing portion, a first resilient contact portion extending from another end of the first body portion, and a contact arm extending horizontally from the first body portion; and a second spring contact, having a second body portion, a second fixing portion extending from one end of the second body portion, a second resilient contact portion extending from another end of the second body portion, and a guide portion bending forwardly and downwardly from the second resilient contact portion; wherein the first resilient contact portion can be urged so that the first contact arm of the first contact moves onto and contacts with the second contact arm of the second spring contact along the guide portion of the second contact.

20. The end position switch as claimed in claim 19, wherein the engaging portion of the second spring contact bends substantially perpendicular to the first mixing portion of the second spring contact.

21. The end position switch as claim in claim 19, wherein the first and second spring contacts respectively have a plurality of tabs protruding downwardly from the first fixing portions thereof.

* * * * *